US006978531B1

(12) United States Patent
Che et al.

(10) Patent No.: US 6,978,531 B1
(45) Date of Patent: Dec. 27, 2005

(54) METHOD OF MANUFACTURING HOT ROLLED STEEL SHEET USING MINI MILL PROCESS

(75) Inventors: Deung-Mo Che, Dongkwangyang (KR); Sang-Il Lee, Dongkwangyang (KR); Yeoung-Rin Min, Dongkwangyang (KR)

(73) Assignee: Pohang Iron & Steel Co., Ltd., Pohang (KR)

( * ) Notice: Subject to any disclaimer, the term of this patent is extended or adjusted under 35 U.S.C. 154(b) by 0 days.

(21) Appl. No.: 09/674,589

(22) PCT Filed: Mar. 4, 1999

(86) PCT No.: PCT/KR99/00102

§ 371 (c)(1),
(2), (4) Date: Nov. 2, 2000

(87) PCT Pub. No.: WO00/51755

PCT Pub. Date: Sep. 8, 2000

(30) Foreign Application Priority Data

Dec. 9, 1997 (KR) ..... 97-66909

(51) Int. Cl.[7] ..... B21B 1/46
(52) U.S. Cl. ..... 29/527.7; 164/476
(58) Field of Search ..... 29/527.7; 164/476, 164/417

(56) References Cited

U.S. PATENT DOCUMENTS 4,709,572 A * 12/1987 Yamada et al. ..... 29/527.7
4,976,306 A 12/1990 Pleschiutschnigg et al.
4,986,341 A * 1/1991 Masuda et al. ..... 164/477
5,303,766 A * 4/1994 Kreijger et al. ..... 164/476
5,307,864 A * 5/1994 Arvedi et al. ..... 164/476
5,329,688 A * 7/1994 Arvedi et al. ..... 29/527.7
5,430,930 A * 7/1995 Passoni et al. ..... 29/527.7
5,461,770 A * 10/1995 Kimura et al. ..... 29/527.7
5,634,257 A * 6/1997 Kajiwara et al. ..... 29/527.7
5,651,411 A * 7/1997 Hirano et al. ..... 164/459
5,832,985 A * 11/1998 Pleschiutschnigg

| | | | | |
|---|---|---|---|---|
| | | | et al. | 164/476 |
| 6,280,542 | B1 * | 8/2001 | Cornelissen et al. | 164/417 |
| 6,533,876 | B1 * | 3/2003 | Cornelissen et al. | 148/541 |
| 6,540,011 | B2 * | 4/2003 | Donini et al. | 164/476 |
| 6,832,432 | B2 * | 12/2004 | Bald et al. | 29/527.7 |

FOREIGN PATENT DOCUMENTS

| | | | | |
|---|---|---|---|---|
| EP | 0 595 282 | A1 | 5/1994 | B21B 1/46 |
| EP | 0 674 952 | A1 | 10/1995 | B21B 1/46 |
| EP | 0 770 433 | A1 | 5/1997 | B21B 1/46 |
| JP | 6-248407 | A | 9/1994 | |
| WO | WO 92/00815 | | 1/1992 | B21B 1/46 |

* cited by examiner

*Primary Examiner*—David P. Bryant
(74) *Attorney, Agent, or Firm*—Fish & Richardson P.C.

(57) ABSTRACT

Disclosed is a method for manufacturing hot rolled steel sheets. The method includes the steps of passing molten steel through a continuous caster (11) having a mold after having been passed through a ladle (91) and a tundish (92) to manufacture a slab; cutting the slab to predetermined lengths using a cutter (14*a*) to form a plurality of cut slabs; heating the cut slabs to a predetermined temperature in a first heating furnace (15*a*) descaling the cut slabs heated in the first heating furnace; rolling the slabs in a reduction unit (13) to a predetermined thickness to form a plurality of flat bars; heating the flat bars to a predetermined temperature in a second heating furnace (15*b*); coiling the flat bars by a coiling station (16*a*) while the flat bars are maintained in a heated state; uncoiling the flat bars by an uncoiler (16*b*); and rolling the flat bars to a predetermined thickness in a finishing mill.

10 Claims, 6 Drawing Sheets

METHOD OF MANUFACTURING HOT ROLLED STEEL SHEET USING MINI MILL PROCESS

BACKGROUND OF THE INVENTION (a) Field of the Invention

The present invention relates to a method of manufacturing hot rolled steel sheets using a mini mill process, and more particularly, to a method in which ultra-thin strip production of hot rolled steel sheets is possible using a mini mill process.

(b) Description of the Related Art

In the mini mill steel making process, the final product is produced in a minimal amount of time using directly connected, short processes starting from a continuous casting process to a rolling process. Accordingly, the mini mill steel making process differs significantly from the blast furnace steel making process.

Although there are many types of mini mill processes, they can be generally divided into two categories depending on the thickness of the resulting slab: a thin slab process in which slabs of less than 70 mm in thickness are produced, and a medium slab process in which slabs of greater than 70 mm in thickness are produced. Also the mini mill process can be divided into two categories depending on the heating and rolling methods used.

As far as the actual method of production is concerned, the typical mini mill processes include the ISP (in-line strip production) process, the CSP (compact strip production) process and the Danieli process.

FIG. 4 shows a schematic view of an ISP process production line. With reference to the drawing, molten steel contained in a ladle 91 is poured into a tundish 92, then passes through a continuous caster 101, having a 75 mm mold, and a liquid core reducer 102. Passing through the continuous caster 101, the molten steel is cast into slabs having a thickness of roughly 60 mm. The slabs, without first being cut to a predetermined length, are descaled in a first descaler 108*a*, then directly rolled in a reduction unit 103 to produce flat bars having a thickness of 20–30 mm.

After passing through the reduction unit 103, the flat bars are cut to suitable lengths by a first cutter 104*a*. The cut flat bars are then heated in a heating furnace 105 and coiled in a coiling station 106*a*. Subsequently, the coiled flat bars are uncoiled in an uncoiler 106*b* then descaled in a second descaler 108*b*. Following this process, the flat bars are rolled in a finishing mill 107 to a predetermined final thickness, after which the flat bars are cooled in a cooler 120 and finally coiled in a down coiler 121. Reference numeral 104*b* in FIG. 4 refers to a second cutter.

In the ISP process described above, since the first cutter 104*a* is connected downstream from the reduction unit 103, the continuous caster 101 and the reduction unit 103 are in effect connected through the slabs being passed therethrough. Thus it is difficult to control the overall process. Further, since the high temperature slabs cast in the continuous caster 101 are rolled in the reduction unit 103, there will be a possibility of the reduction unit 103 to be deformed by the temperature of the slabs. In addition, the cast slabs are directly rolled in the reduction unit 103 without any heating. As a result, a difference in temperature between edges and a center of the slabs may occur, causing surface defects in the slabs.

In addition, since descaling is performed in the first descaler 108*a* immediately following continuous casting, optimal-descaling is not achieved. That is, because a scale thickness is limited and there is only a small number of pores on a scale layer, a bonding force between the scales and matrix of the slabs is very high.

With regard to the CSP process, with reference to FIG. 5, molten steel contained in a ladle 91 is poured into a tundish 92 as in the ISP process described above. The molten steel is cast into slabs after passing through a continuous caster 201 and a liquid core reducer 202. The slabs are then cut to suitable lengths by a cutter 204. The cut slabs are heated in a heating furnace 205 having a length of at least 170 m. In the heating furnace 205, the slabs are heated to a temperature suitable for rolling. Following this step, the heated slabs are descaled by a descaler 208 then rolled by six rollers, after which the rolled slabs are cooled by a cooler 220 then coiled by a coiler 221.

In the CSP process described above, because of the considerable length of the heating furnace 205, up to three slabs can be positioned therein at one time. This increases manufacturing productivity. Additionally, since the slabs produced in another continuous caster (not shown) are not directly transmitted to the rollers 207, the heating furnace 205 has to be rotated or moved to feed the slabs into the rollers 207. Another feature of the CSP process is that a reduction unit is not required as in the CSP process since slabs of less than 50 mm in thickness are produced by the continuous caster 201.

However, a drawback of the CSP process is that productivity lags behind other methods which manufacture slabs of medium thickness since casting is done at a faster rate than needed to produce slabs of medium thickness.

Referring now to FIG. 6, illustrating a schematic view of the Danieli process production line, after molten steel in a ladle 91 is poured into a tundish 92, the molten steel being solidified undergoes soft reduction in a 90 mm mold of a continuous caster 301 and a liquid core reducer 302 such that slabs of 70 mm in thickness are produced. The slabs are then cut to suitable lengths by a first cutter 304*a*. The cut slabs are descaled in a first descaler 308*a* then heated to a temperature suitable for rolling in a first heating furnace 305. The first heating furnace 305 has a substantial length so that a plurality of slabs can be heated therein at one time.

Because medium slabs are manufactured in the Danieli process, both a roughing mill 303 and a finishing mill 307 are provided. That is, after the slabs are rolled into flat bars by the roughing mill 303, the flat bars undergo rolling also in the finishing mill 307. A heated cover 305*b* is provided between the roughing mill and finishing mills 303 and 307 to ensure that the flat bars are maintained at an appropriate temperature before being supplied to the finishing mill 307. The length of the heated cover 305*b* is determined depending on a length of one flat bar. After rolled in the finishing mill 307, the flat bars are cooled by a cooler 320 then coiled by a final coiler 321. Reference numeral 322 in FIG. 6 refers to a width roller, and reference numerals 304*b*, 308*b* and 308*c* refer respectively to a second cutter, a second descaler and a third descaler.

In the Danieli process as described above, because of the extensive length of the heated cover 305*b* (equal to the length of one slab), an overall length of the Danieli production line is increased.

SUMMARY OF THE INVENTION

The present invention has been made in an effort to solve the above problems.

It is an object of the present invention to provide a method of manufacturing hot rolled steel sheets using a mini mill process in which it is easy to control the process, high descalability and ability to easily realize width rolling are achieved, and the production of ultra-thin strips of hot rolled steel sheets is possible.

To achieve the above object, the present invention provides a method of manufacturing hot rolled steel sheets using a mini mill process. The method includes the steps of passing molten steel through a continuous caster having a mold after having been poured into a ladle and a tundish to manufacture a slab; cutting the slab to predetermined lengths using a cutter to form a plurality of cut slabs; heating the cut slabs to a predetermined temperature in a first heating furnace; descaling the cut slabs heated in the first heating furnace; rolling the slabs in a reduction unit to a predetermined thickness to form a plurality of flat bars; heating the flat bars to a predetermined temperature in a second heating furnace; coiling the flat bars by a coiling station while the flat bars are maintained in a heated state; uncoiling the flat bars by an uncoiler; and rolling the flat bars to a predetermined thickness in a finishing mill.

According to a feature of the present invention, the slabs are heated to a temperature 1000° C. and above by the first heating furnace.

According to another feature of the present invention, the slabs are heated to a temperature between 1000 and 1200° C. for 5–6 minutes by the first heating furnace.

According to yet another feature of the present invention, the slabs undergo width rolling before being descaled and after being heated by the first heating furnace.

According to still yet another feature of the present invention, the slabs being rolled in the reduction unit are maintained to a temperature between 800 and 1000° C. at an output of the reduction unit.

According to still yet another feature of the present invention, the slabs casted in the continuous caster undergo liquid core reduction.

According to still yet another feature of the present invention, a thickness of the slabs casted in the continuous caster is 100 mm, and the slabs undergo liquid core reduction to a thickness of 80 mm.

In another aspect, after the flat bars are uncoiled by the uncoiler, the flat bars are cut to a predetermined length; ends of the flat bars are joined; the flat bars are rolled to a predetermined thickness in the finishing mill; and the flat bars are cut to a predetermined length.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

Preferred embodiments of the present invention will now be described in detail with reference to the accompanying drawings.

Figure 1:
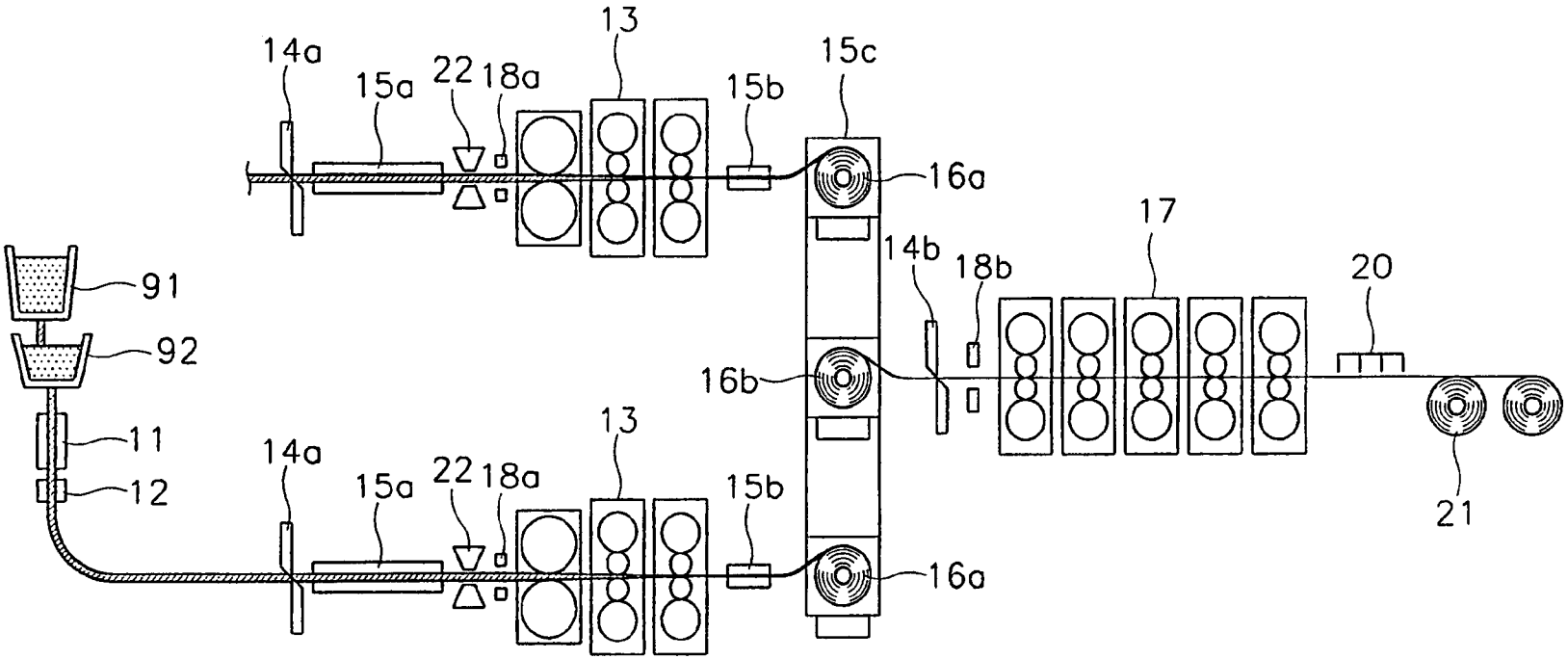
FIG. 1 is a schematic view of a production line for a mini mill process according to a first preferred embodiment of the present invention.

FIG. 1 shows a schematic view of a production line for a mini mill process according to a first preferred embodiment of the present invention. Molten steel is poured into a ladle 91 and a tundish 92 continuously, then passed through a continuous caster 11 having a mold such that the molten steel is manufactured into a continuous slab. It is also possible to provide a liquid core reducer 12 downstream from the continuous caster 11 where the continuous slab undergoes reduction. The mold of the continuous caster 11 is a straight parallel mold.

The mold of the continuous caster 11 preferably has an interval of approximately 100 mm. This is done to minimize an output opening of the mold taking into consideration a refractory life, and to minimize an amount and speed of output flow such that a temperature of the molten steel in the mold is maintained at a uniform level. Accordingly, a high degree of quality can be ensured. Further, it is preferable that the liquid core reducer 12 performs an approximately 20 mm core reduction. In this way, by controlling conditions of the continuous casting and the liquid reduction, a slab of approximately 80 mm is produced such that load given to a roller is reduced and quality is improved.

A first cutter 14*a* is provided upstream from a first heating furnace 15*a*. The first cutter 14*a* cuts the slabs to predetermined suitable lengths such that the continuous casting process and a subsequent rolling operation are independently performed such that control problems do not occur and greater stability is achieved. The cut slabs pass through the first heating furnace 15*a*, where the slabs are heated to a temperature suitable for rolling, after which the slabs are rolled in a reduction unit 13. Here, it is preferable that the heating temperature is over 1000° C., and more preferably between 1000 and 1200° C. Further, it is preferable that the slabs are heated at the preferred temperature for approximately 5–6 minutes.

The reason for heating the slabs before being rolled in the reduction unit 13 will now be described. Since S (sulfur) solubility of austenite is extremely low, during the phase transformation of $\delta \rightarrow \gamma$, S is segregated on grain boundaries, and S and Fe react to form FeS, and the FeS reacts with the Fe to form Fe—FeS. Because the Fe—FeS on a grain boundary exists as a liquid at approximately 988° C., grain boundary strength is reduced such that cracks occur during rolling.

However, in the case where Mn (manganese) is contained in steel, when S of the grain boundaries is precipitated into MnS, brittleness disappears. $Mn+S \rightarrow MnS$ precipitation and growth reaction are determined by diffusibility of Mn, and if maintained for approximately 10 minutes at 1050° C., over 70% of S is precipitated into MnS.

Accordingly, in the present invention, the slabs are heated to the conditions as described above before being rolled by the reduction unit 13 so that during the phase transformation of $\delta \rightarrow \gamma$, S, which is segregated on grain boundaries, does not react with Fe, but rather with Mn to form MnS, thereby preventing the formation of cracks during rolling.

The slabs heated as in the above then undergo descaling by a first descaler 18*a* before being rolled by the reduction unit 13. Since the slabs are descaled in the present invention after being heated, rather than immediately following continuous casting, this descaling operation can be effectively carried out. That is, after heating the slabs, scales on the slabs are thick and a number of pores thereon are high such that a bonding force between the scales and the slabs is weak, thereby enabling easy descaling of the slabs.

Preferably, a width roller 22 is mounted upstream from the first descaler 18*a* for controlling a width of the slabs before the descaling operation. At this time, the slabs are width-rolled based on a thickness of the slabs, and the width roller 22 enables the width of the slabs to be rolled up to roughly 14–15 mm. Further, by the width rolling of the slabs before the descaling operation, cracks are formed on the scales such that the subsequent descaling of the slabs is improved.

Following the above, the descaled slabs are rolled in the reduction unit 13. At this time, a rolling amount and a number of roller stands used are determined by considering a desired thickness of the final product. Preferably, the reduction unit 13 includes three stands that are structured such that an 80 mm slab enters the reduction unit 13 and is formed into 15–30 mm flat bars. Here, it is possible for the reduction unit 13 to include only two stands to form 20–30 mm flat bars. Flat bars exiting the reduction unit 13 are at a temperature between 800 and 1000° C.

A second heating furnace 15*b* is provided downstream from the reduction unit 13. The second heating furnace 15*b* heats the flat bars exiting the reduction unit 13 to a temperature between 1030 and 1080° C. such that a finishing mill 17 can more easily roll the flat bars, thereby enabling the economic manufacture of ultra-thin strips. Here, in order to more effectively heat the flat bars, it is preferable to use an inductive heater for the second heating furnace 15*b*. In the case where an inductive heater is utilized, output of the inductive heater is determined by the degree to which the temperature of the flat bars is increased, the inductive heater being flexibly used depending on an output temperature of the reduction unit 13. Preferably, an extractor is mounted in the second heating furnace 15*b* to extract defective, particularly start and end defective slabs.

The flat bars heated by the second heating furnace 15*b* are then coiled in a coiling station 16*a*. It is preferable that the coiling station 16*a* is mounted in a holding furnace 15*c* so that the temperature to which the flat bars are raised by the second heating furnace 15*b* can be maintained. Preferably, a size of the holding furnace 15*c* is such that it can hold about 8–10 bar coils at one time so that if problems occur in the finishing mill 17, the continuous caster 11 can proceed with its casting operation and does not need to be stopped.

The bar coils are then uncoiled in an uncoiler 16*b* before being supplied to the finishing mill 17 where the flat bars undergo a final rolling process. It is preferable that a second cutter 14*b* is provided between the uncoiler 16*b* and the finishing mill 17. The second cutter 14*b* cuts ends of the flat bars so that the final rolling process is proceeded without any interruption.

In addition, it is preferable that a second descaler 18*b* is provided immediately upstream from the finishing mill 17, between the second cutter 14*b* and the finishing mill 17. Further, since a number of stands of the finishing mill 17 determines a thickness of the final product, it is preferable to provide a total of 5 stands for the finishing mill 17 to enable the ultra-thin strip production of hot rolled steel sheets. Moreover, to ensure the high quality formation of the final product, it is preferable to maintain a predetermined roll interval. A formation controller (not shown) can be provided for this purpose. Also, it is preferable to provide a grinder (not shown) which grinds the rolls to control friction between edge portions of the rolls.

A cooler 20 is provided downstream from the finishing mill 17, and the flat bars rolled in the finishing mill 17 are supplied to the cooler 20 where the flat bars are cooled. Further, a down coiler 21 is provided downstream from the cooler 20. The flat bars cooled in the cooler 20 are coiled in the down coiler 21.

As shown in FIG. 1, the above first cutting process, first heating process, width rolling process, first descaling process, first rolling process, second heating process, and first coiling process can be simultaneously performed at a plurality of locations to increase productivity.

Figure 2:
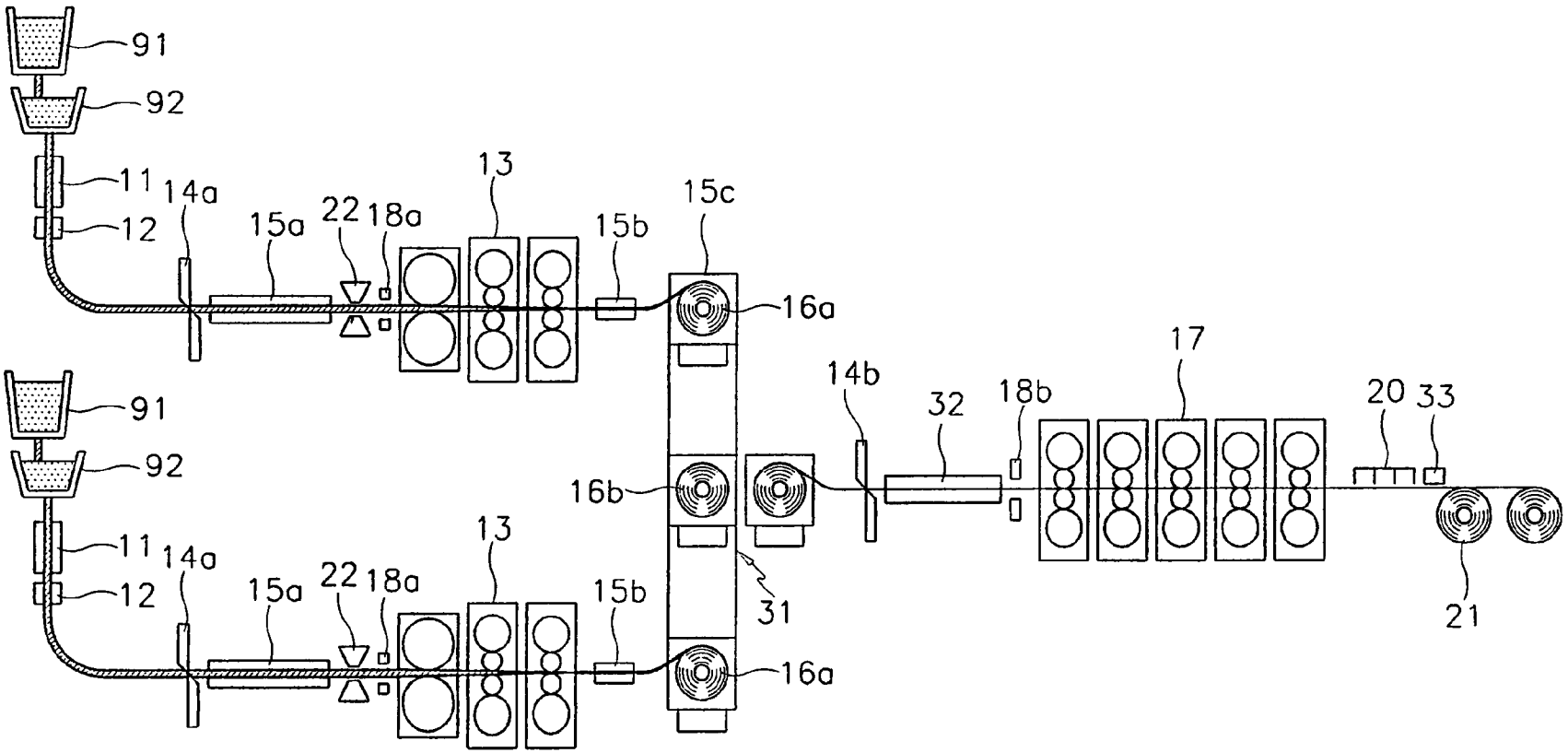
FIG. 2 is a schematic view of a production line for a mini mill process according to a second preferred embodiment of the present invention.

FIG. 2 shows a schematic view of a production line for a mini mill process according to a modified example of the first preferred embodiment of the present invention. In the drawing, identical reference numerals will be used for elements similar to those appearing in FIG. 1, and except for added elements, it is to be assumed that the elements appearing in both the drawings are identical in operation.

As shown in the drawing, a plurality of uncoilers 31 are provided downstream from the coiling stations 16*a*. Further, a bar joiner 32 is provided downstream from the second cutter 14*b*, between the second cutter 14*b* and the second descaler 18*b*. The bar joiner 32 joins a rear end of a bar undergoing rolling in the finishing mill to a front end of a bar waiting to be rolled such that the flat bars can be continuously rolled. Finally, a high speed cutter 33 is provided between the cooler 20 and the down coiler 21 which cuts the flat bars cooled in the coiler 20 to suitable lengths. A structure of the plurality of uncoilers 31 is commonly known in the art.

Figure 3:
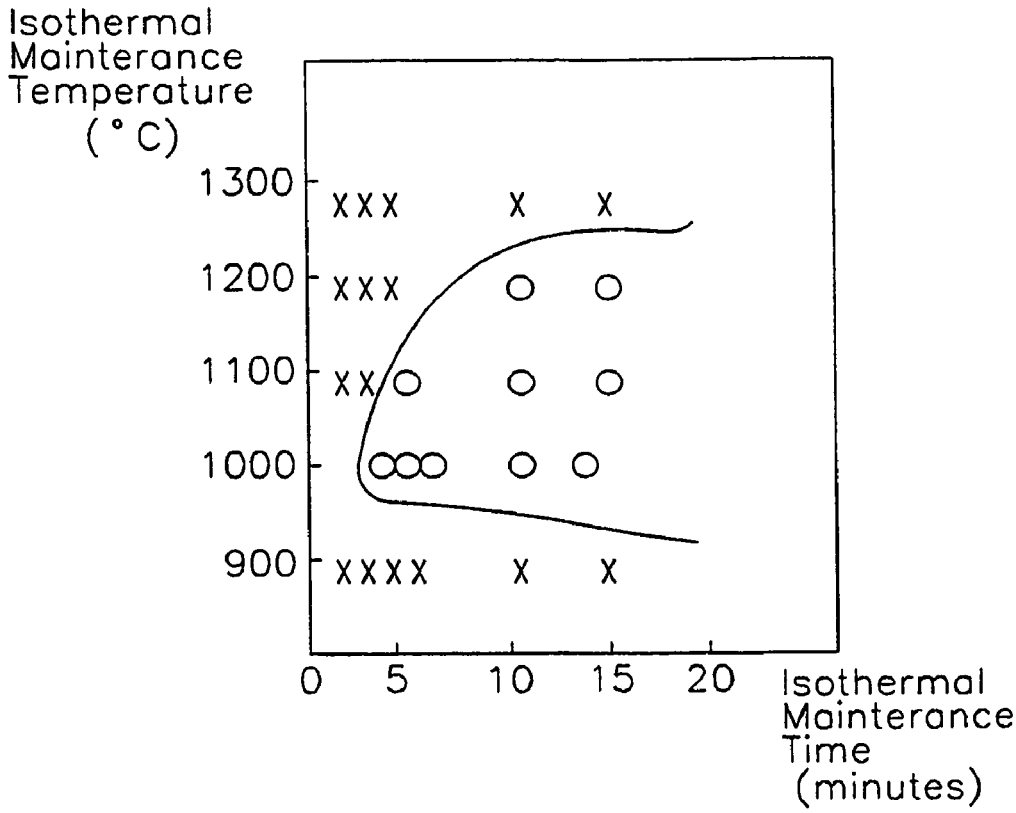
FIG. 3 is a graph illustrating at which relation between an isothermal maintenance time and an isothermal maintenance temperature edge crack occurs.
Figure 4:
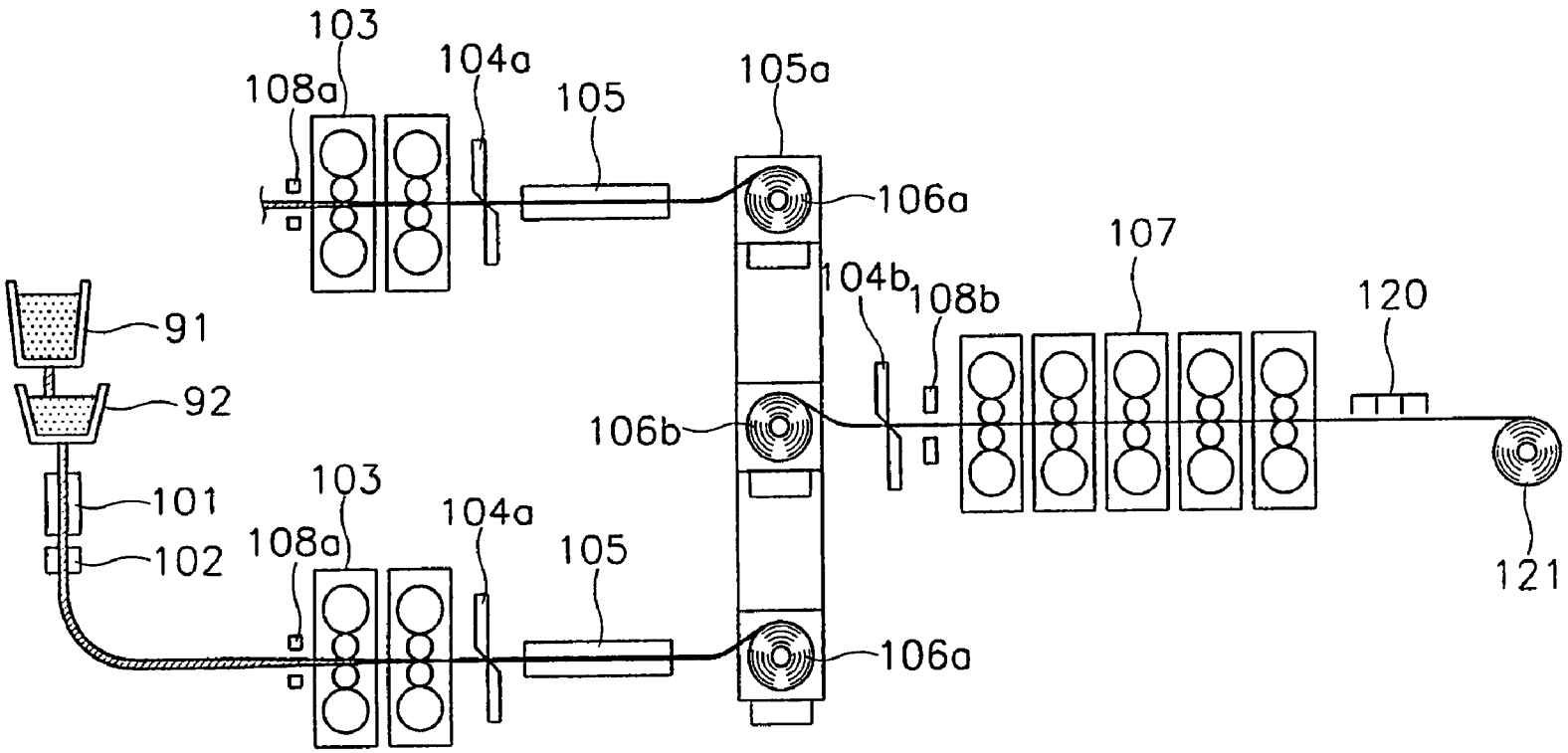
FIG. 4 (Prior Art)
FIG. 4 is a schematic view of a production line for a conventional ISP mini mill process.
Figure 5:
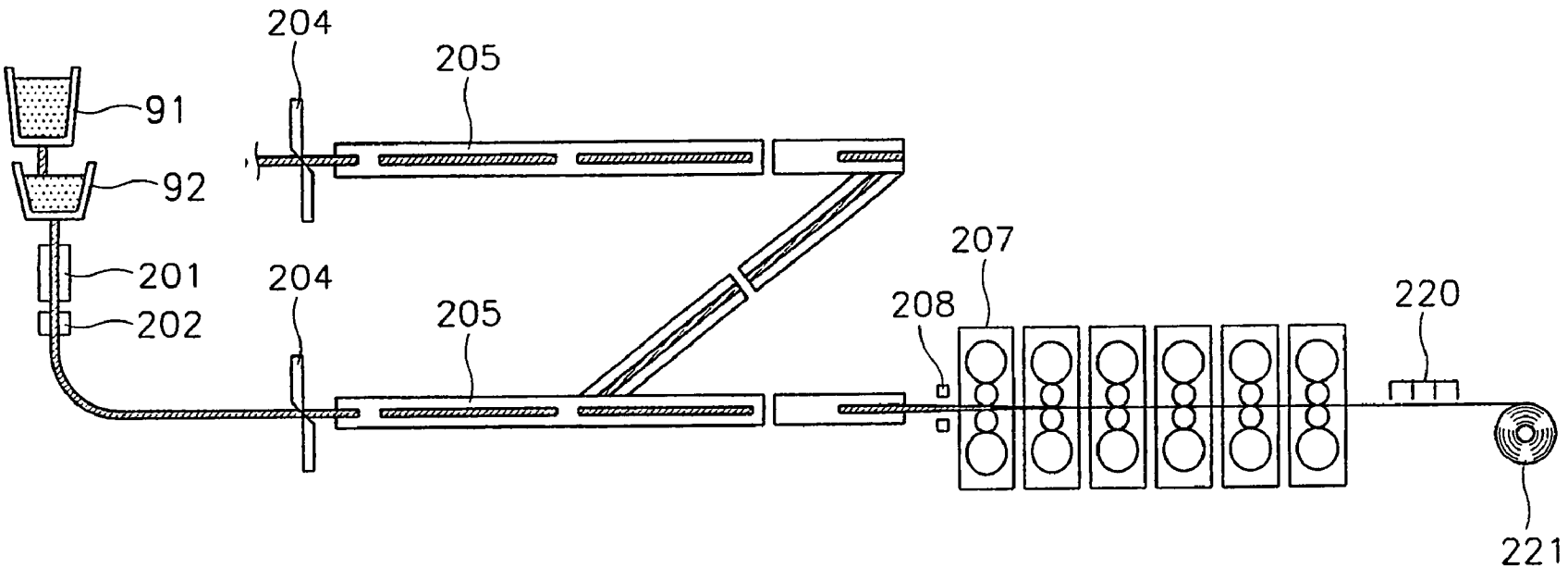
FIG. 5 (Prior Art)
FIG. 5 is a schematic view of a production line for a conventional CSP mini mill process.
Figure 6:
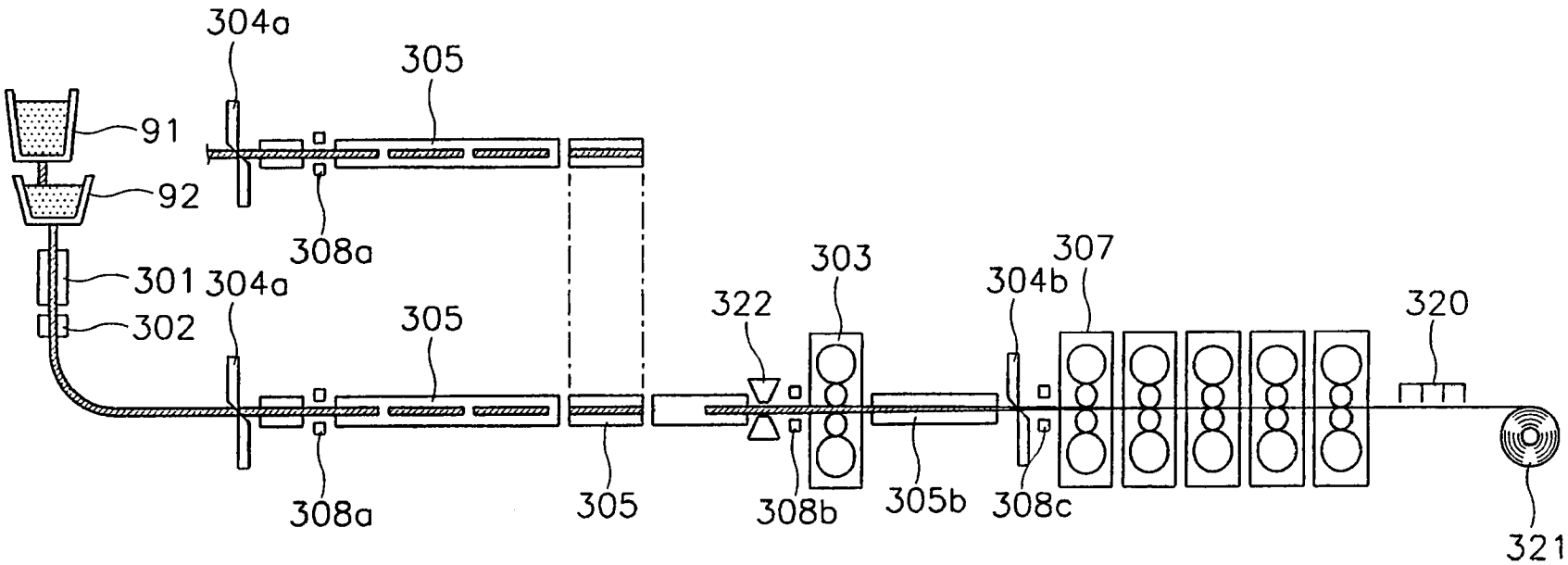
FIG.6 (Prior Art)
FIG. 6 is a schematic view of a production line for a conventional Danieli mini mill process.

FIG. 3 is a graph illustrating at which relation between an isothermal maintenance time and an isothermal maintenance temperature that edge crack occurs. As shown in the drawing, if maintained for a suitable amount of time at a temperature above 900° C., no edge crack occurs.

In the method of manufacturing hot rolled steel sheets using the mini mill process described above, since it is easy to control the process, high descalability and an ability to easily realize width rolling are achieved, and the production of ultra-thin strips of hot rolled steel sheets is possible, casting stability is ensured, the quality of the final product is improved, various different specifications can be catered to, and productivity is improved. Further, with the ability to perform casting on a non-stop basis, defects in the final product are reduced and the occurrence of the flying phenomenon can be prevented.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A method for manufacturing hot rolled steel sheets comprising the steps of:

passing molten steel through a continuous caster having a mold after having been poured into a ladle and a tundish to manufacture a slab;

cutting the slab to predetermined lengths using a cutter to form a plurality of cut slabs;

heating the cut slabs to 1000° C. or above to form MnS precipitation on the cut slabs in a first heating furnace;

width rolling the cut slabs by using a width roller;

descaling the cut slabs heated in the first heating furnace;

rolling the slabs in a reduction unit to a predetermined thickness to form a plurality of flat bars;

heating the flat bars to a predetermined temperature in a second heating furnace;

coiling the flat bars by a coiling station while the flat bars are maintained in a heated state;

uncoiling the flat bars by an uncoiler; and rolling the flat bars to a predetermined thickness in a finishing mill.

2. The method of claim 1 wherein the slabs are heated to a temperature between 1000 and 1200° C. for 5–6 minutes by the first heating furnace.

3. The method of claims 1 or 2 wherein the slabs being rolled in the reduction unit are maintained to a temperature between 800 and 1000° C. at an output of the reduction unit.

4. The method of claim 3 wherein the slabs casted in the continuous caster undergo liquid core reduction.

5. The method of claim 4 wherein a thickness of the slabs casted in the continuous caster is 100 mm, and the slabs undergo liquid core reduction to a thickness of 80 mm.

6. The method of claims 1 or 2 wherein the slabs casted in the continuous caster undergo liquid core reduction.

7. The method of claim 6 wherein a thickness of the slabs casted in the continuous caster is 100 mm, and the slabs undergo liquid core reduction to a thickness of 80 mm.

8. The method of claim 1 wherein the slabs being rolled in the reduction unit are maintained to a temperature between 800 and 1000° C. at an output of the reduction unit.

9. The method of claim 8 wherein the slabs casted in the continuous caster undergo liquid core reduction.

10. The method of claim 9 wherein a thickness of the slabs casted in the continuous caster is 100 mm, and the slabs undergo liquid core reduction to a thickness of 80 mm.

* * * * *